US007838473B2

(12) United States Patent
Shaw et al.

(10) Patent No.: US 7,838,473 B2
(45) Date of Patent: Nov. 23, 2010

(54) LUBRICATING OIL COMPOSITION

(75) Inventors: Robert W. Shaw, Abingdon (GB); Michele Anne Thornhill, West Hagbourne (GB)

(73) Assignee: Infineum International Limited, Oxfordshire (GB)

( * ) Notice: Subject to any disclaimer, the term of this patent is extended or adjusted under 35 U.S.C. 154(b) by 451 days.

(21) Appl. No.: 11/226,793

(22) Filed: Sep. 14, 2005

(65) Prior Publication Data

US 2006/0068999 A1 Mar. 30, 2006

(30) Foreign Application Priority Data

Sep. 27, 2004 (EP) ..... 04255876

(51) Int. Cl.

| | |
|---|---|
| ***C10M 169/04*** | (2006.01) |
| ***C10M 135/18*** | (2006.01) |
| ***C10M 163/00*** | (2006.01) |
| ***C10M 133/12*** | (2006.01) |

(52) U.S. Cl. ..... 508/287; 508/363; 508/371; 508/185; 508/460; 508/563

(58) Field of Classification Search ..... 508/287, 508/363, 364, 185, 460, 365, 371, 375, 563, 508/586

See application file for complete search history.

(56) References Cited

U.S. PATENT DOCUMENTS

| | | | | |
|---|---|---|---|---|
| 2003/0148895 | A1 | 8/2003 | Robson et al. | 508/155 |
| 2003/0148900 | A1 * | 8/2003 | Palazzotto et al. | 508/501 |
| 2004/0077506 | A1 * | 4/2004 | Arrowsmith et al. | 508/185 |

FOREIGN PATENT DOCUMENTS

| | | | |
|---|---|---|---|
| EP | 1 167 497 | A2 | 1/2002 |
| EP | 1 361 263 | A1 | 11/2003 |
| WO | WO03/064568 | | 8/2003 |

* cited by examiner

*Primary Examiner*—Glenn A Caldarola
*Assistant Examiner*—Vishal Vasisth

(57) ABSTRACT

A lubricating oil composition of TBN 8-9 having up to 0.3 wt. % sulfur, up to 0.08 wt. % phosphorus, and a sulfated ash content up to 0.80 wt. %, comprising an overbased magnesium-containing lubricating oil detergent, and 2.5 to 4 wt. % of a nitrogen-containing ashless dispersant.

8 Claims, No Drawings

LUBRICATING OIL COMPOSITION

The present invention relates to lubricating oil compositions. More particularly, the present invention relates to lubricating oil compositions, which have low levels of phosphorus, sulfur and sulfated ash.

Environmental concerns have led to continued efforts to reduce the CO, hydrocarbon and nitrogen oxide ($NO_x$) emissions of compression ignited (diesel-fueled) and spark ignited (gasoline-fueled) light duty internal combustion engines. Further, there have been continued efforts to reduce the particulate emissions of compression ignited light duty internal combustion engines. To meet the upcoming emission standards for passenger cars, original equipment manufacturers (OEMs) will rely on the use of additional exhaust gas after-treatment devices. Such exhaust gas after-treatment devices may include catalytic converters, which can contain one or more oxidation catalysts, $NO_x$ storage catalysts, and/or $NH_3$ reduction catalysts; and/or a particulate trap.

Oxidation catalysts can become poisoned and rendered less effective by exposure to certain elements/compounds present in engine exhaust gasses, particularly by exposure to phosphorus and phosphorus compounds introduced into the exhaust gas by the degradation of phosphorus-containing lubricating oil additives. Reduction catalysts are sensitive to sulfur and sulfur compounds in the engine exhaust gas introduced by the degradation of both the base oil used to blend the lubricant, and sulfur-containing lubricating oil additives. Particulate traps can become blocked by metallic ash, which is a product of degraded metal-containing lubricating oil additives.

One of the most effective antioxidant and antiwear agents, from both a performance and cost-effectiveness standpoint, used conventionally in lubricating oil compositions for internal combustion engines comprises dihydrocarbyl dithiophosphate metal salts. The metal may be an alkali or alkaline earth metal, or aluminum, lead, tin, molybdenum, manganese, nickel or copper. Of these, zinc salts of dihydrocarbyl dithiophosphate (ZDDP) are most commonly used. While such compounds are particularly effective antioxidants and antiwear agents such compounds introduce phosphorus, sulfur and ash into the engine that can shorten the service life of exhaust gas after-treatment devices, as described supra.

To insure a long service life, lubricating oil additives that exert a minimum negative impact on such after-treatment devices must be identified, and OEM specifications for "new service fill" and "first fill" lubricants are expected to require maximum sulfur levels of 0.30 wt. %; maximum phosphorus levels of 0.08 wt. %, and sulfated ash contents below 0.80 wt. %. Such lubricating oil compositions can be referred to as "low SAPS" (low sulfated ash, phosphorus, sulfur) lubricating oil compositions.

At the same time, the selected lubricating oil composition must provide adequate lubricant performance, including adequate wear protection and detergency. The performance of lubricating oil compositions used in light duty spark and compression-ignited vehicular internal combustion engines, specifically antiwear and engine cleaning performance, must be maintained at the high level dictated by the "new service", and "first fill" specifications of the OEM's. The present invention is based on the discovery that a lubricating oil can be formulated which complies with the low SAPS requirements yet exhibits a passing value for piston cleanliness and viscosity control in the fired engine XUD-IIBTE test and satisfies the requirements of the Mercedes-Benz Seals test surprisingly through use of a magnesium detergent and a relatively high ashless dispersant content.

In accordance with the present invention there is provided a lubricating oil composition having a sulfur content of up to 0.3 wt. %, a phosphorus content of up to 0.08 wt. %, a sulfated ash content of up to 0.80 wt. % and a total base number (TBN) of about 8 to 9 which comprises an admixture of:

(a) a major amount of an oil of lubricating viscosity selected from one of more of the group consisting of Group I, Group II, Group III, Group IV, Group V and synthetic ester base stock oils;

(b) an overbased magnesium-containing lubricating oil detergent having a TBN of 200 to 500 present in such amount so as to provide a TBN of between 5.3 and 7.3 to the lubricating oil composition; and (c) an ashless dispersant, present in an amount of 2.5 to 4 wt. % and providing the lubricating oil composition with a nitrogen content of 0.05 to 0.1 wt. %.

Unless otherwise stated, all amounts of additives are reported in wt. % on an active ingredient ("a.i.") basis, i.e., independent of the diluent or carrier oil.

Oil of Lubricating Viscosity

The oil of lubricating viscosity may be selected from Group I, II, III, IV or V base stocks or synthetic ester base stocks. The base stock groups are defined in the American Petroleum Institute (API) publication "Engine Oil Licensing and Certification System", Industry Services Department, Fourteenth Edition, December 1996, Addendum 1, December 1998. The base stock will have a viscosity preferably of 3-12, more preferably 4-10, most preferably 4.5-8 $mm^2/s$ (cSt.) at 100° C.

(a) Group I mineral oil base stocks contain less than 90% saturates and/or greater than 0.03% sulfur and have a viscosity index greater than or equal to 80 and less than 120, measured using the test methods specified in Table A below.

(b) Group II mineral oil base stocks contain greater than or equal to 90% saturates and less than or equal to 0.03% sulfur and have a viscosity index greater than or equal to 80 and less than 120 using the test methods specified in Table A below.

(c) Group III mineral oil base stocks contain greater than or equal to 90% saturates and less than or equal to 0.03% sulfur and have a viscosity index greater than or equal to 120 using the test methods specified in Table A below.

(d) Group IV base stocks are polyalphaolefins (PAO).

(e) Group V base stocks are all base stocks not included in Groups I, II, I or IV.

(f) Suitable ester base stocks that can be used comprise the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol 2-ethylhexyl alcohol, ethylene glycol, diethylene glycol monoether, propylene glycol, etc.) Specific examples of these esters include dibutyl adipate, di(e-ethylhexyl) sebacate, din-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic base stock oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

TABLE A

Analytical Methods for Testing Base Stocks

| Property | Test Method |
|---|---|
| Saturates | ASTM D2007 |
| Viscosity Index | ASTM D2270 |
| Sulfur | ASTM D2622, D4294, D4927, or D3120 |

Preferably, the oil of lubricating viscosity comprises substantially no Group I base stock oil.

The oil of lubricating viscosity used in this invention should have a viscosity index of at least 95, preferably at least 100. Preferred oils are (a) base oil blends of Group III base stocks with Group II base stocks, where the combination has a viscosity index of at least 110; or (b) Group III base stocks or blends of more than one Group III base stock. Mineral oils are preferred.

Metal Detergent

The present invention requires the presence of an overbased magnesium-containing lubricating oil detergent having a TBN of 200 to 500, preferably 300 to 500, in such amount so as to provide to the lubricating oil composition a TBN of 5.3 to 7.3 of the total required TBN of 8 to 9. Preferably, there will be employed 0.4 to 1.0 wt. % of the magnesium detergent. The magnesium detergent is preferably a magnesium alkyl salicylate.

Lubricating oil compositions according to the present invention surprisingly exhibit a "pass" rating in certain aspects of the XUD-IIBTE test and in the Mercedes-Benz Seals test, while the same oil formulated without a magnesium detergent will show distinctly poorer results in the same test. Other types of metal detergents may be present so long as the sulfated ash content of the oil remains at 0.80 wt. % or less.

Metal-containing or ash-forming detergents function both as detergents to reduce or remove deposits and as acid neutralizers or rust inhibitors, thereby reducing wear and corrosion and extending engine life. Detergents generally comprise a polar head with long hydrophobic tail, with the polar head comprising a metal salt of an acid organic compound. The salts may contain a substantially stoichiometric amount of the metal in which they are usually described as normal or neutral salts, and would typically have a total base number (TBN), as may be measured by ASTM D-2896 of from 0 to 80. It is possible to include large amounts of a metal base by reacting an excess of a metal compound, such as an oxide or hydroxide, with an acid gas such as carbon dioxide. The resulting overbased detergent comprises neutralized detergent as the outer layer of a metal base (e.g., carbonate) micelle. Such overbased detergents may have a TBN of 150 or greater, and overbased detergents typically used have a TBN from 200 to 500, or more.

Detergents that are conventionally employed include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., barium, sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased metal detergents having TBN of from 20 to 450. Combinations of detergents, whether overbased or neutral or both, may be used.

Sulfonates may be prepared from sulfonic acids, which are typically obtained by the sulfonation of alkyl substituted aromatic hydrocarbons such as those obtained from the fractionation of petroleum or by the alkylation of aromatic hydrocarbons. The alkaryl sulfonates usually contain from about 9 to about 80 or more carbon atoms, preferably from about 16 to about 60 carbon atoms per alkyl substituted aromatic moiety.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

Carboxylate detergents, e.g., salicylates, can be prepared by reacting an aromatic carboxylic acid with an appropriate metal compound such as an oxide or hydroxide and neutral or overbased products may be obtained by methods well known in the art. The aromatic moiety of the aromatic carboxylic acid can contain heteroatoms, such as nitrogen and oxygen. Preferably, the moiety contains only carbon atoms; more preferably the moiety contains six or more carbon atoms; for example benzene is a preferred moiety. The aromatic carboxylic acid may contain one or more aromatic moieties, such as one or more benzene rings, either fused or connected via alkylene bridges.

Preferred substituents in oil-soluble salicylic acids are alkyl substituents. In alkyl—substituted salicylic acids, the alkyl groups advantageously contain 5 to 100, preferably 9 to 30, especially 14 to 20, carbon atoms. Where there is more than one alkyl group, the average number of carbon atoms in all of the alkyl groups is preferably at least 9 to ensure adequate oil solubility.

Ashless Dispersant

Ashless dispersants generally comprise an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersant may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons, long chain aliphatic hydrocarbons having a polyamine attached directly thereto; and Mannich condensation products formed by condensing a long chain substituted phenol with formaldehyde and polyalkylene polyamine.

Dispersants of the present invention are nitrogen containing and are present in amounts of from 2.5 to 4.0 wt %. The nitrogen content of the lubricant composition provided by the dispersant should be in the range of 0.05 to 0.1 wt. % N. Preferred are borated or non-borated polyisobutenyl succinimide dispersants wherein the polyisobutenyl has an Mn of about 500 to 3,000, preferably about 900 to 2,500. A preferred embodiment utilizes polyisobutenyl succinimide dispersants prepared using polyisobutylene prepared from a pure isobutylene stream or a Raffinate I stream to prepare reactive isobutylene polymers with terminal vinylidene olefins. Preferably, these polymers, referred to as highly reactive polyisobutylene (HR—PIB), have a terminal vinylidene content of at least 65%, e.g., 70%, more preferably at least 80%, most preferably at least 85%. The preparation of such polymers is described, for example, in U.S. Pat. No. 4,152,499. HR—PIB is known and HR—PIB is commercially available under the tradenames Glissopal™ (from BASF) and Ultravis™ (from BP-Amoco).

Preferred, but optional ingredients, are antioxidants, zinc dihydrocarbyldithiophosphates, oil soluble organomolybdenum compounds, friction modifiers, and viscosity modifiers.

Antioxidants

Antioxidants reduce the tendency of base stocks to deteriorate in service which deterioration can be evidenced by the products of oxidation such as sludge and varnish-like deposits on the metal surfaces and by viscosity growth. They are suitably present in amount of from 0.1 to 5.0 wt. %, preferably 0.25 to 1.0 wt. %. Suitable oxidation inhibitors include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, alkyl substituted diphenylamine, alkyl substituted phenyl and napthylamines, phosphorous esters, metal thiocarbamates, ashless thiocarbamates and oil soluble copper compounds as described in U.S. Pat. No. 4,867,890. Most preferred are the dialkyl substituted diphenylamines, wherein the alkyl is $C_4$-$C_{20}$, such as dinonyl diphenylamine and the hindered phenols, such as isooctyl-3,5-di-tert-butyl-4-hydroxycinnamate and mixtures of same.

Zinc Dihydrocarbyldithiophosphates

The zinc dihydrocarbyl dithiophosphates are oil soluble salts of dihydrocarbyl dithiophosphoric acids and may be represented by the following formula:

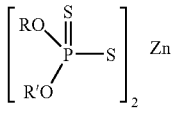

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate (ZDDP) can therefore comprise zinc dialkyl dithiophosphates. ZDDP is the most commonly used antioxidant/antiwear agent in lubricating oil compositions for internal combustion engines, and in conventional passenger car diesel engines formulated to meet present European ACEA specifications. The lubricating oil compositions of the present invention suitably contain an amount of ZDDP (or other dihydrocarbyl dithiophosphate metal salt) that introduces about 0.02 to 0.08 wt. %, preferably 0.02 to 0.06 wt. % of phosphorus into the lubricating oil composition. The phosphorus content of the lubricating oil compositions is determined in accordance with the procedures of ASTM D5185.

Molybdenum Compound

For the lubricating oil compositions of this invention, any suitable oil soluble organo-molybdenum compound may be employed. The molybdenum compound will function both as an antiwear and antioxidant additive. Preferably, dimeric and trimeric molybdenum compounds are used. Examples of such oil soluble organo-molybdenum compounds are the dialkyldithiocarbamates, dialkyldithiophosphates, dialkyldithiophosphinates, xanthates, thioxanthates, carboxylates and the like, and mixtures thereof. Particularly preferred are molybdenum dialkylthiocarbamates.

The molybdenum dialkyldithiocarbamate dimer to be used as an additive in the present invention is a compound expressed by the following formula:

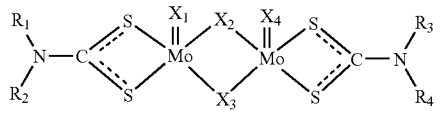

$R_1$ through $R_4$ independently denote a straight chain, branched chain or aromatic hydrocarbyl group; and X1 through X4 independently denote an oxygen atom or a sulfur atom. The four hydrocarbyl groups, $R_1$ through $R_4$, may be identical or different from one another.

Another group of organo-molybdenum compounds useful in the lubricating compositions of this invention are trinuclear (trimeric) molybdenum compounds, especially those of the formula $MO_3S_kL_nQ_z$ and mixtures thereof wherein the L are independently selected ligands having organo groups with a sufficient number of carbon atoms to render the compound soluble in the oil, n is from 1 to 4, k varies from 4 to 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The ligands are selected from the group consisting of

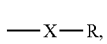

1

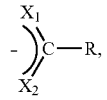

2

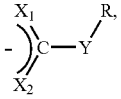

3

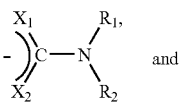

and

4

-continued

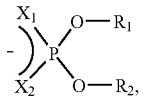

and mixtures thereof, wherein X, $X_1$, $X_2$, and Y are independently selected from the group of oxygen and sulfur, and wherein $R_1$, $R_2$, and R are independently selected from hydrogen and organo groups that may be the same or different. Preferably, the organo groups are hydrocarbyl groups such as alkyl (e.g., in which the carbon atom attached to the remainder of the ligand is primary or secondary), aryl, substituted aryl and ether groups. More preferably, each ligand has the same hydrocarbyl group.

The term "hydrocarbyl" denotes a substituent having carbon atoms directly attached to the remainder of the ligand and is predominantly hydrocarbyl in character within the context of this invention. Such substituents include the following:

1. Hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well as cyclic substituents wherein the ring is completed through another portion of the ligand (that is, any two indicated substituents may together form an alicyclic group).

2. Substituted hydrocarbon substituents, that is, those containing non-hydrocarbon groups which, in the context of this invention, do not alter the predominantly hydrocarbyl character of the substituent. Those skilled in the art will be aware of suitable groups (e.g., halo, especially chloro and fluoro, amino, alkoxyl, mercapto, alkylmercapto, nitro, nitroso, sulfoxy, etc.).

Importantly, the organo groups of the ligands have a sufficient number of carbon atoms to render the compound soluble in the oil. For example, the number of carbon atoms in each group will generally range between about 1 to about 100, preferably from about 1 to about 30, and more preferably between about 4 to about 20. Preferred ligands include dialkyldithiophosphate, alkylxanthate, carboxylates, dialkyldithiocarbamate, and mixtures thereof. Most preferred are the dialkyldithiocarbamates. Those skilled in the art will realize that formation of the compounds requires selection of ligands having the appropriate charge to balance the core's charge (as discussed below).

Compounds having the formula $Mo_3S_kL_nQ_z$ have cationic cores surrounded by anionic ligands, wherein the cationic cores are represented by structures such as

6

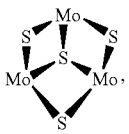

and

-continued

7

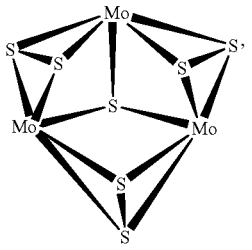

which have net charges of +4. Consequently, in order to solubilize these cores the total charge among all the ligands must be −4. Four monoanionic ligands are preferred. Without wishing to be bound by any theory, it is believed that two or more trinuclear cores may be bound or interconnected by means of one or more ligands and the ligands may be multidentate, i.e., having multiple connections to one or more cores. It is believed that oxygen and/or selenium may be substituted for sulfur in the core(s).

Oil-soluble trinuclear molybdenum compounds are preferred and can be prepared by reacting in the appropriate liquid(s)/solvent(s) a molybdenum source such as $(NH_4)_2Mo_3S_{13}.n(H_2O)$, where n varies between 0 and 2 and includes non-stoichiometric values, with a suitable ligand source such as a tetralkylthiuram disulfide. Other oil-soluble trinuclear molybdenum compounds can be formed during a reaction in the appropriate solvent(s) of a molybdenum source such as $(NH_4)_2Mo_3S_{13}.n(H_2O)$, a ligand source such as tetralkylthiuram disulfide, dialkyldithiocarbamate, or dialkyldithiophosphate, and a sulfur abstracting agent such cyanide ions, sulfite ions, or substituted phosphines. Alternatively, a trinuclear molybdenum-sulfur halide salt such as $[M']_2[Mo_3S_7A_6]$, where M' is a counter ion, and A is a halogen such as Cl, Br, or I, may be reacted with a ligand source such as a dialkyldithiocarbamate or dialkyldithiophosphate in the appropriate liquid(s)/solvent(s) to form an oil-soluble trinuclear molybdenum compound. The appropriate liquid/solvent may be, for example, aqueous or organic.

The ligand chosen must have a sufficient number of carbon atoms to render the compound soluble in the lubricating composition. The term "oil-soluble" as used herein does not necessarily indicate that the compounds or additives are soluble in the oil in all proportions. It does mean that they are soluble in use, transportation, and storage.

A sulfurized molybdenum containing composition prepared by (i) reacting an acidic molybdenum compound and a basic nitrogen compound selected from the group consisting of succinimide, a carboxylic acid amide, a hydrocarbyl monoamine, a phosphoramide, a thiophosphoramide, a Mannich base, a dispersant viscosity index improver, or a mixture thereof, in the presence of a polar promoter, to form a molybdenum complex (ii) reacting the molybdenum complex with a sulfur containing compound, to thereby form a sulfur and molybdenum containing composition is useful within the context of this invention. The sulfurized molybdenum containing compositions may be generally characterized as a molybdenum/sulfur complex of a basic nitrogen compound. The precise molecular formula of these molybdenum compositions is not known with certainty. However, they are believed to be compounds in which molybdenum, whose valences are satisfied with atoms of oxygen or sulfur, is either complexed by, or the salt of one or more nitrogen atoms of the basic nitrogen containing compound used in the preparation of these compositions.

The lubricating compositions of the present invention may contain a minor amount of an oil soluble molybdenum compound. An amount of at least 10 ppm up to about 2,000 ppm of molybdenum from a molybdenum compound may be present in the lubricating oil composition. Preferably, about 500 ppm to 1,000 ppm of molybdenum from a molybdenum compound is used. These values are based upon the weight of the lubricating composition.

Friction Modifiers

At least one organic oil soluble friction modifier may preferably be incorporated in the lubricating oil composition. Typically, the friction modifier makes up about 0.02 to 2.0 wt. % of the lubricating oil composition. Preferably, from 0.05 to 1.0, more preferably from 0.1 to 0.5 wt. % of the friction modifier is used.

Friction modifiers include such compounds as aliphatic amines or ethoxylated aliphatic amines, aliphatic fatty acid amides, aliphatic carboxylic acids, aliphatic carboxylic esters of polyols such as glycerol esters of fatty acids as exemplified by glycerol oleate, which is preferred, aliphatic carboxylic ester-amides, aliphatic phosphonates, aliphatic thiophosphates, etc., wherein the aliphatic group usually contains above about eight carbon atoms so as to render the compound suitably oil soluble. Also suitable are aliphatic substituted succinimides formed by reacting one or more aliphatic succinic acids or anhydrides with ammonia.

Lubricating Oil Flow Improver

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like. These may be used in amounts of from 0.01 to 5.0 wt. %, preferably about 0.1 to 3.0 wt. %. They are preferably used when mineral oil base stocks are employed but are not required when the base stock is a PAO or synthetic ester.

Viscosity Modifier

The viscosity modifier (VM) functions to impart high and low temperature operability to a lubricating oil. The VM used may have that sole function, or may be multifunctional. It may be present in amounts of from 0.01 to 20.0 wt. %, preferably about 1.0 to 10.0 wt. %. These are preferably employed when the base stock is a mineral oil.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Foam control can be provided by many compounds including an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and does not require further elaboration.

The individual additives may be incorporated into a base stock in any convenient way. Thus, each of the components can be added directly to the base stock or base oil blend by dispersing or dissolving it in the base stock or base oil blend at the desired level of concentration. Such blending may occur at ambient temperature or at an elevated temperature. The invention comprising the product results from the admixture of the additive components to form a lubricating oil composition.

Preferably, all the additives except for the viscosity modifier and the pour point depressant are blended into a concentrate or additive package described herein as the additive package, which is subsequently blended into base stock to make the finished lubricant. The concentrate will typically be formulated to contain the additive(s) in proper amounts to provide the desired concentration in the final formulation when the concentrate is combined with a predetermined amount of a base lubricant.

The concentrate is preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

The final crankcase lubricating oil formulation may employ from 2 to 20 mass %, preferably 4 to 18 mass %, and most preferably about 5 to 17 mass % of the concentrate or additive package, with the remainder being base stock.

EXAMPLE 1

The following inventive Oil A and comparative Oils B and C were prepared and tested for piston merits and viscosity increase according to the XUD-IIBTE fired engine test, a European passenger car diesel engine test (CEC L-56-T-98) that is part of the ACEA B specification. Oils A and C were also tested in the Mercedes-Benz Seals test. The results are given in Table 1. Inventive Oil A shows a distinct and surprising improvement.

Oil A: a lubricating oil composition was prepared containing 0.54 wt. % magnesium alkyl salicylate detergent (TBN 340), 1.32 wt. % calcium alkyl salicylate detergent, organomolybdenum antiwear agent, friction modifier, 3.23 wt. % polyisobutenyl succinimide dispersant, antioxidant, lubricating oil flow improver, viscosity modifier, antifoam agent, zinc dihydrocarbyl dithiophosphate and mineral oil base stocks. The dispersant provided 0.07 wt % nitrogen to the lubricant composition.

This oil had 0.2 wt. % sulfur, 0.08 wt. % phosphorus and 0.78 wt. % sulfated ash and had a TBN of 8.7.

Oil B: the formulation of Oil A above was duplicated except that the magnesium detergent was replaced with 1.60 wt. % of a calcium salicylate detergent. The dispersant provided 0.07 wt % nitrogen to the lubricating oil composition. Oil B had 0.2 wt % sulfur, 0.08 wt % phosphorus, 0.78 wt % sulfated ash and a TBN of 7.7.

Oil C: the formulation of Oil B above was duplicated except that there was present 3.93 wt. % of the same dispersant. The dispersant provided 0.08 wt % nitrogen to the lubricating oil composition. Oil C had 0.2 wt % sulfur, 0.08 wt % phosphorus, 0.8 wt % sulfated ash and a TBN of 8.2.

TABLE 1

| OIL TESTED | OIL A | OIL B | OIL C |
|---|---|---|---|
| Absolute Viscosity Increase @ 100° C. with 3% Soot (CST) | 25.4 | 35.7 | 29.2 |
| Reference Oil (RL197 Abs. Vis. Inc. @ 100° C. with 3% Soot | 58.9 | 61.8 | 61.8 |
| Piston Merit Average | 51.3 | 47.0 | 53.3 |
| Reference Oil RL197 Piston Merit Ave. | 50.7 | 50.7 | 50.7 |

| OIL TESTED | | | LIMIT | |
|---|---|---|---|---|
| Mercedes-Benz Seals | OIL A | OIL C | Min | Max |
| NBR34 PCT Elongation at Break | −30 | −38 | −35 | |
| NBR34 PCT Tensile Strength Change | −8.7 | −10 | −20 | |
| NBR34 PCT Volume Change | 0.7 | 0.5 | 0 | 10 |
| NBR34 PTS Hardness Change | 0 | 1 | −8 | 2 |

The invention claimed is:

1. A lubricating oil composition having a sulfur content of up to about 0.3 wt. %, a phosphorus content of from about 0.02 to about 0.08 wt. %, a sulfated ash content of up to about 0.80 wt. % and a total base number of about 8 to 9 mg KOH/g, which lubricating oil composition comprises an admixture of:

(a) a major amount of oil of lubricating viscosity selected from one or more of the group consisting essentially of, Group II, Group III, Group IV, Group V and synthetic ester base stock oils;

(b) overbased detergent in such amount so as to provide a TBN of from about 5.3 to about 7.3 mg KOH/g to the lubricating oil composition, which overbased detergent comprises from about 0.4 to about 1.0 wt. % of overbased magnesium-containing lubricating oil detergent having a TBN of 200 to 500 and an amount of overbased calcium salicylate detergent providing said lubricating oil composition with the remainder of the from about 5.3 to about 7.3 mg KOH/g TBN provided by overbased detergent; and (c) an ashless dispersant present in an amount of at least about 2.5 to about 4 wt. % and providing the lubricating oil composition with a nitrogen content of from about 0.05 to about 0.1 wt. %.

2. A composition according to claim 1, further comprising one or more additives selected from the group consisting of antioxidants, zinc dihydrocarbyldithiophosphates, oil soluble organomolybdenum compounds, friction modifiers and viscosity modifiers.

3. A composition according to claim 1, wherein the dispersant is a polyisobutenyl succinimide.

4. A composition according to claim 2, wherein the antioxidant is (i) a dialkyl diphenylamine wherein the alkyl is $C_4$-$C_{20}$ alkyl, (ii) a hindered phenol, or a combination thereof.

5. A composition according to claim 2, wherein the hydrocarbyl groups of the zinc dihydrocarbyldithiophosphate have 2 to 8 carbon atoms.

6. A composition according to claim 2, wherein the organomolybdenum compound is a dialkyldithiocarbamate.

7. A composition according to claim 1, wherein the oil of lubricating viscosity is a mineral oil.

8. A method of improving piston cleanliness comprising adding to an engine a lubricating oil composition according to claim 1.

* * * * *